US010001008B2

(12) United States Patent
Cook, II et al.

(10) Patent No.: US 10,001,008 B2
(45) Date of Patent: Jun. 19, 2018

(54) SYSTEM AND METHOD FOR PROVIDING BROADBAND COMMUNICATIONS OVER POWER CABLING

(71) Applicant: TRINITY SOLUTIONS, Mount Nebo, WV (US)

(72) Inventors: William Charles Cook, II, Oceana, WV (US); Christopher Scott Skaggs, Victor, WV (US); Michael Charles Pritt, Victor, WV (US)

(73) Assignee: Trinity Solutions, Mount Nebo, WV (US)

( * ) Notice: Subject to any disclaimer, the term of this patent is extended or adjusted under 35 U.S.C. 154(b) by 804 days.

(21) Appl. No.: 14/084,605

(22) Filed: Nov. 19, 2013

(65) Prior Publication Data

US 2014/0139350 A1 May 22, 2014

Related U.S. Application Data

(60) Provisional application No. 61/728,596, filed on Nov. 20, 2012.

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC ..... E21B 47/122
See application file for complete search history.

(56) References Cited

U.S. PATENT DOCUMENTS 4,667,193 A * 5/1987 Cotie ..... G06F 13/22 340/10.32
4,689,619 A * 8/1987 O'Brien, Jr. ..... H04J 3/0682 340/10.2

(Continued)

FOREIGN PATENT DOCUMENTS

EP 1021867 B1 4/2002
RO 120998 B1 10/2006

(Continued)

OTHER PUBLICATIONS

Romano Napolitano, "Keynote III. Communications over HV-MV-LV Power Lines: Europe Standards and Regulations overview," p. 33, date unknown.

(Continued)

*Primary Examiner* — Quang D Pham
(74) *Attorney, Agent, or Firm* — Kenealy Vaidya LLP

(57) ABSTRACT

Systems and methods for providing broadband communication to and from locations in hostile environments, such as mines, pits, quarries, wells, boreholes, and rigs, for example, are disclosed. According to a first aspect of the present application, a system is disclosed for providing broadband communication via power cabling. The system may comprise one or more broadband communication devices for modulating, demodulating, reconditioning, repeating, transmitting, and receiving a signal via a power cable. The system may further comprise one or more broadband communication devices operatively connected to mining electrical distribution system components and mining equipment to provide broadband communication amongst the components, equipment, and other broadband communication devices within and outside the mine facility via the power cable.

1 Claim, 11 Drawing Sheets

(56) References Cited

U.S. PATENT DOCUMENTS 5,349,644 A * 9/1994 Massey ..... B63B 43/00 340/12.37
5,446,918 A * 8/1995 Lamy ..... H04L 1/20 455/86
5,967,616 A * 10/1999 Offutt ..... E21C 27/24 299/30
6,040,759 A 3/2000 Sanderson
6,522,626 B1 2/2003 Greenwood
6,927,672 B2 8/2005 Zalitzky et al.
6,980,091 B2 * 12/2005 White, II ..... H04B 3/56 333/24 R
6,995,657 B2 2/2006 Zalitzky et al.
7,079,012 B2 7/2006 Wetmore
7,173,938 B1 * 2/2007 Davidow ..... H04B 3/542 370/401
7,406,536 B2 7/2008 Efrati et al.
7,518,487 B2 4/2009 Zalitzky et al.
7,616,968 B2 * 11/2009 Waye ..... H04B 5/0018 455/517
7,667,344 B2 2/2010 Zitting et al.
7,738,612 B2 6/2010 Rafaeli
7,742,393 B2 * 6/2010 Bonicatto ..... H04B 3/54 340/12.37
7,873,129 B2 1/2011 Goldfisher et al.
7,937,065 B2 5/2011 Refaeli et al.
8,005,100 B2 * 8/2011 Barrett ..... E21F 17/18 370/310
8,116,714 B2 * 2/2012 Black ..... H04B 3/54 455/117
8,149,106 B2 4/2012 Refaeli et al.
9,258,722 B2 * 2/2016 Schmidt ..... G01D 21/00
2002/0092015 A1 * 7/2002 Sprunk ..... H04N 7/1675 725/9
2002/0178455 A1 * 11/2002 Poli ..... H04N 7/165 725/109
2003/0133473 A1 * 7/2003 Manis ..... H04B 3/542 370/480
2004/0264501 A1 12/2004 Zalitzky et al.
2006/0079198 A1 4/2006 Sanderson
2008/0063093 A1 3/2008 Refaeli et al.
2008/0112704 A1 * 5/2008 Needle ..... H04J 14/0226 398/71
2009/0128347 A1 5/2009 Bucella et al.
2009/0140852 A1 6/2009 Stolarczyk et al.
2010/0020784 A1 1/2010 Goldfisher et al.
2010/0073149 A1 3/2010 Goldfisher et al.
2010/0073192 A1 3/2010 Goldfisher et al.
2010/0076612 A1 3/2010 Robertson
2010/0150172 A1 6/2010 Zalitzky et al.
2010/0195744 A1 8/2010 Schwager et al.
2010/0256862 A1 10/2010 Verhardt
2010/0271044 A1 10/2010 Keret
2013/0191652 A1 * 7/2013 Seok ..... G06F 1/26 713/300
2013/0314068 A1 * 11/2013 Zhen ..... G05F 3/30 323/313

FOREIGN PATENT DOCUMENTS

WO 2012009754 A1 1/2012
WO WO 2012009754 A1 * 1/2012 ..... H04B 5/0018

OTHER PUBLICATIONS

Daniel Fink and Rho Jae Jeung, PhD, "Feasible connectivity solutions of PLC for rural and remote areas," 978-1-4244-1976-0/08, Copyright 2008, pp. 158-163, IEEE.
Written Opinion and International Search Report for PCT/US2013/071045, dated Apr. 14, 2014, 18 pages.
International Preliminary Examination Report for PCT/US2013/071045, dated May 26, 2015.

* cited by examiner

SYSTEM AND METHOD FOR PROVIDING BROADBAND COMMUNICATIONS OVER POWER CABLING

CROSS-REFERENCE TO RELATED APPLICATIONS

This application claims priority from U.S. Provisional Patent Application No. 61/728,596, filed on Nov. 20, 2012, which is incorporated by reference herein in its entirety.

TECHNICAL FIELD

The present application generally relates to systems, devices, and methods for providing broadband communication to/from locations in hostile environments, such as mines, pits, quarries, wells, boreholes, and rigs for example. More specifically, the present application relates to a system and method for providing broadband communications over power cabling. The present application also describes devices that cooperate with existing high voltage and other cabling to enable distribution of broadband communications between a surface facility and facilities in hostile environments.

BACKGROUND

Certain methods and systems have previously been used for providing broadband communications to locations in hostile environments. Some such systems rely on wireless RF ("WiFi") communications. Other such systems rely on fiber optic or other dedicated cabling.

Survivability in cases of disaster and the ability to operate for extended periods of time in harsh conditions are concerns for users of communications applications in hostile environments. Specifically, the dedicated cabling and the wireless communications hardware employed by current underground communications systems are easily damaged and are ill suited for long term use in adverse conditions.

Accordingly, there is a need for robust systems, methods and devices that enable broadband communications to, from, and between locations in hostile environments. Specifically, a need exists for a system providing broadband communications to locations in hostile environments that is durable and has superior survivability rates. A need further exists for a system for providing broadband communications to locations in hostile environments that utilizes existing hardware and cabling known to withstand harsh conditions.

SUMMARY

In one embodiment, an underground mining communication system is provided, the underground mining communication system comprising: a power center, the power center providing electrical energy via one or more electrical connections; one or more shielded mining power cables, the one or more shielded mining power cables operable to connect to the power center, one or more broadband communication device, and mining equipment; one or more frequency blocking devices; one or more broadband communication devices operable to at least one of modulate, demodulate, recondition, repeat, transmit, and receive communication signals via the one or more shielded mining power cables and further operable to communicate with another one or more broadband communication devices.

In another embodiment, an underground mining communication system is provided, the underground mining communication system comprising: a power distribution center, the power distribution center comprising: a substation, a switchgear, and one or more power center, the one or more power center comprising: one or more electrical energy input, one or more electrical energy output, one or more connection operatively connected to the one or more electrical energy output, one or more power distribution transformer, the one or more power distribution transformer operable to transfer an electrical energy from the one or more electrical energy input to the one or more energy output, wherein the one or more power distribution transformer has a primary winding and a secondary winding, at least one signal path to ground, one or more emergency stop switches, one or more interlock switches, the power center further operable to provide the electrical energy via the one or more connection; one or more shielded mining power feeder cable, the one or more shielded mining power cable having one or more connection and operable to connect to at least one of: the one or more connection of the power center, one or more connection operatively connected to one or more broadband communication device, and one or more connection operatively connected to mining equipment; one or more trailing power cable, the one or more trailing power cable having one or more connection operable to connect to at least one of: the one or more connection of the power center, the one or more connection of the one or more broadband communication device, and the one or more mechanical connection of the mining equipment; one or more first frequency blocking device, the one or more first frequency blocking device passing frequencies in a range of 0 kHz-5 kHz, wherein the first frequency blocking device is operatively connected to the signal path to ground of the power center, and wherein the first frequency blocking device is a low pass filter; one or more second frequency blocking device, the one or more second frequency blocking device passing frequencies over 100 kHz, wherein the one or more second frequency blocking device is operatively connected to at least one of: the one or more emergency stop switches of the power center, the one or more interlock switches of the power center, and wherein the one or more second frequency blocking device is a high pass filter; one or more first broadband communication device, the first broadband communication device operatively connected to the one or more shielded mining power feeder cable, the first broadband communication operable to at least one of modulate and demodulate signals, and transmit and receive signals via the one or more shielded mining power feeder cable; one or more second broadband communication device, the one or more second broadband communication device operatively connected to the one or more shielded mining power feeder cable and the primary winding of the one or more power distribution transformer, the one or more second broadband communication device operable to at least one of modulate and demodulate signals, and transmit and receive signals via the one or more shielded mining power feeder cable; one or more third broadband communication device, the one or more third broadband communication device operatively connected to the secondary winding of the one or more power distribution transformer and least one of: the one or more shielded mining power feeder cable, and the one or more trailing power cable, the one or more third broadband communication device operable to at least one of modulate and demodulate signals, and transmit and receive signals via at least one of: the one or more shielded mining power feeder cable, and the one or more trailing power cable; one or more fourth broadband communication device operatively connected to at least one of: a fixed mining equipment, and a mobile mining equipment, and the one or more fourth broadband communication device further operatively connected to at least one of: the one or more shielded mining power feeder cable, and the one or more trailing power cable, the one or more fourth broadband communication device operable to at least one of modulate and demodulate signals, and transmit and receive signals via at least one of: the one or more shielded mining power feeder cable, and the one or more trailing power cable, such that the one or more fourth broadband communication device is operable to communicated with the one or more third broadband communication device via the at least one of: the one or more shielded mining power feeder cable, and the one or more trialing power cable; one or more fifth broadband communication device, the one or more fifth broadband communication device operatively connected to at least one of: the one or more shielded mining power feeder cable, and the one or more trailing power cable, the one or more fifth broadband communication device operable to at least one of modulate and demodulate signals, transmit signals, receive signals, condition signals, and repeat signals via at least one of: the one or more shielded mining power feeder cable, and the one or more trailing power cable; a first element within the one or more broadband communication device for transmitting signals; and a second element within the one or more broadband communication device for receiving signals.

In another embodiment, a method for providing broadband communication over shielded power mine cabling in underground mines is provided, the method comprising: connecting at least a first broadband communication device to one or more shielded power mine cabling; connecting at least a second broadband communication device to a power center and the one or more shielded power mine cabling; connecting at least a third broadband communication device to a primary winding of a distribution transformer of the power center and the one or more shielded power mine cabling; connecting at least a fourth broadband communication device to a secondary winding of the distribution transformer of the power center and the one or more shielded power mine cabling; connecting at least a fifth broadband communication device to a high voltage mining equipment within an underground mine and the one or more shielded power mine cabling; generating a signal that will be transmitted by at least one of: a first broadband communication device, a second broadband communication device, a third broadband communication device, a fourth broadband communication device, and a fifth broadband communication device; modulating the generated signal to be transmitted over the one or more shielded power mine cabling; transmitting the modulated signal over the one or more shielded power mine cabling; preventing communication signal loss over the one or more shielded power mine cabling using a frequency blocking device; receiving the modulated signal at least one of: the first broadband communication device, the second broadband communication device, the third broadband communication device, the fourth broadband communication device, and the fifth broadband communication device, the at least one receiving broadband communication device different than the at least one transmitting broadband communication device; and demodulating the received signal, the demodulated signal to be further processed by the at least one receiving broadband communication device.

In another embodiment, a signal isolation ring is provided, the signal isolation ring comprising: a first signal isolation ring, the first signal isolation ring operatively connected to an inside of an equipment frame; a second signal isolation ring, the second signal isolation ring operatively connected to an outside of an equipment frame; and one or more electrical bushing between the first signal isolation ring and the second isolation ring; wherein the signal isolation ring is operable to prevent a signal to ground path via one or more mounting bolt of an electrical cable coupler.

BRIEF DESCRIPTION OF THE DRAWINGS

The accompanying figures, which are incorporated in and constitute a part of the specification, illustrate various example systems, devices, and methods, and are used merely to illustrate various example embodiments. It should be noted that various components depicted in the figures may not be drawn to scale, and that the various assemblies and designs depicted in the figures are presented for purposes of illustration only, and should not be considered in any way as limiting.

DETAILED DESCRIPTION

Figure 1:
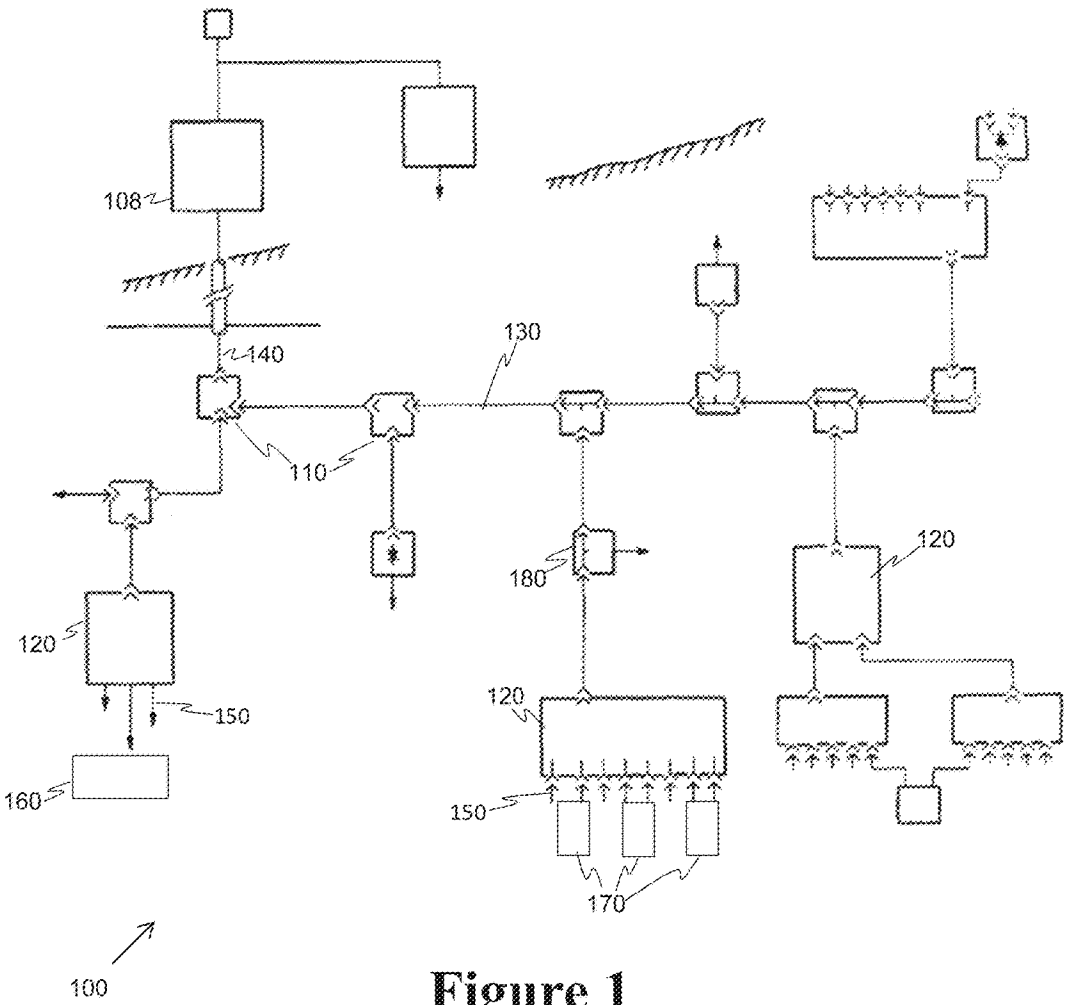
FIG. 1 illustrates an underground mining power distribution system.

Hostile environment worksites use power distribution systems to distribute electrical energy from a power grid or other energy source for use by systems in the worksite. One such hostile environment is a mine, illustrated in power distribution system 100 shown in FIG. 1. Due to the nature of underground mining, underground mine power distribution systems 100 are almost always radial in structure. Such power distribution systems, and their specific components, are regulated by rule 30 CFR 75 of the Code of Federal Regulations. A general description of common mine power distribution systems are given in "Mine Power Systems" Information Circular 9258, herein incorporated by reference. As shown in FIG. 1, components of a mine power distribution system include, among other things, a substation 108, a switchhouse 110, a power center 120, cabling 130, 140, 150, fixed mining equipment 160 and mobile mining equipment 170, and distribution transformer 180.

Possible embodiments of substation 108 typically include a main (or primary) substation, which transforms voltage levels from a utility company to a primary distribution voltage for the mine, and underground portable and unit substations that serve to transform the primary distribution voltage to a lower distribution voltage for use by mining loads and equipment 160 and 170.

Switchhouse 110 may have a primary role including the providing of protective relaying in distribution system 100 and the allowance of branching of the radial distribution system.

Power center 120 and distribution transformers 180 may function as portable substations, transferring and converting the distribution voltage to utilization levels. As with switchhouse 110, each of power center 120 and distribution transformer 180 have its own set of internal protection components such as emergency stop switches and interlock switches.

Cabling 130, 140, and 150 may be used to carry power and grounding between the various power equipment and eventually to mine loads and mining equipment 160 and 170. Generally, cabling may be termed feeder cabling when part of the distribution system 100 and/or connected to fixed mining equipment 160 and trailing cabling when connected to portable/mobile mining equipment 170. Fixed mining equipment 160 may include shops, pumps, or other equipment fixed at a particular location while mobile mining equipment 170 may include continuous miners, shuttle cars, bolters and other portable and mobile equipment.

This present application describes systems, devices and methods for providing broadband communications to and within an underground location. Specifically, the present application describes systems and methods for utilizing shielded power cabling to transmit broadband communications to, from, and within locations in hostile environments, such as mines, pits and quarries, tunnels, wells, boreholes, and rigs for example.

The systems, devices, and methods described herein advantageously supply broadband communications to, from, and within hostile environment such as the underground workings of a mine, pit, quarry, tunnel, well, borehole, and rig, for example, via existing or new high-voltage cabling, such as MPF-GGC, MP-GC, G-GC, W-type cabling, submarine cabling, and any other cabling commonly known in mining, drilling, mineral extract, and other applicable arts as will be known to the ordinary artisan. Such communications provide the capability to transmit information from processes and/or machines, as well as voice and/or video to and from external facilities, point to multipoint and/or point to point within the underground workings. The high-voltage power cabling currently available for mining and other harsh underground environments may be used to provide a robust communication medium as disclosed in association with one or more embodiments of the present invention. Such cabling may be a substantially stationary cable (for example, cables 130, cables 140, and the cables 150 connecting equipment 160) or mobile cable (for example, cables 150 connecting equipment 170) and may be a shielded or unshielded cable depending on the application as would be known to one of ordinary skill in the art. The mobile cables often termed "trailing cables" are typically used to connect and power mobile equipment.

The present application describes systems, devices, and methods that enable high speed data communication via existing or new high voltage feeder cabling or trailing cabling. Information from, for example, fixed or mobile mining equipment may be aggregated at power center(s) 120 located throughout the facility or site. The information may then be communicated over the relevant power cabling (i.e., 130, 140, and/or 150) to the surface facility for use or distribution to other personnel or facilities around the world via the internet or other dedicated networks or communication systems.

With reference to FIG. 1, hostile environment worksites use power distribution systems 100 to distribute electrical energy from a power grid or other energy source for use by systems in the worksite. A power distribution system 100 may include electrical substation 108 to transform a voltage from power grid or other energy source for use by systems in the worksite. Power distribution system 100 may also include a switchgear or switchhouse 110, which may include electrical disconnects, fuses or circuit breakers to isolate, protect, and control electrical circuits and equipment. Power distribution system 100 may also include one or more power centers 120. Power centers 120 may be a portable or stationary device operable to take an input voltage or input electrical energy and transfer the input voltage or input electrical energy to one or more output voltage or output electrical energy. Power centers 120 may use one or more power distribution transformers 180 having a primary winding and a secondary winding to transfer input voltage and input electrical energy to output voltage and output electrical energy. In one embodiment, one or more power distribution transformers 180 are housed within power centers 120, though power distribution transformers 180 are not limited to being housed within power centers 120 and may be located in other parts of power distribution system 100. Power distribution transformers 180 may at least one of: isolate input voltage and input electrical energy from output voltage and output electrical energy, step up input voltage and input electrical energy such that output voltage and output electrical energy is greater than input voltage and input electrical energy, and step down input voltage and input electrical energy such that output voltage and output electrical energy is less than input voltage and input electrical energy. Power center 120 may also include one or more mechanical connections (not shown), however power center is not limited to mechanical connections and may include electrical or magnetic couplings such as inductive or capacitive couplings. Other embodiments will be known to those of ordinary skill in the art. Power center mechanical connections may interface with power cabling connections such that power cabling 130, 140, and 150 may operatively connect to power center 120 to transfer an input voltage and input energy to power center 120, and transfer an output voltage or output energy from power center 120 for use by worksite systems 160 and 170. Power center 120 also includes standard electrical safety features, including for example: a plurality of emergency stop switches, a plurality of interlock switches, and a ground conductor or signal path to ground (not shown).

Using the systems, devices and methods of the present application, high-speed broadband communications, including data, video and/or voice, via a broadband communication signal such as a Broadband over Powerline ("BPL") signal or a Digital Subscriber Loop ("DSL") signal, may be transmitted to all or selected mobile and/or stationary equipment or processes located in all or selected locations of underground workings of a mine, tunnel, pit, quarry, well, borehole, and rig. Such communication may be accomplished by connecting phase wire(s), ground wire(s) and/or ground check wire(s) to a broadband communication modem or other broadband communication device either directly, capacitively, or inductively coupled.

In some embodiments, broadband communication devices, such as BPL and DSL devices, may be connected with an amplifier, boards, or additional circuitry and/or with an impedance matching network. In some embodiments, an impedance matching network may be a manually tuned or set device or may be completely automated with a computer, microcontroller, or other embedded device capable of detecting and tuning impedance of impedance matching network. Impedance matching network may also monitor and/or adjust a signal. Impedance matching network may also monitor and/or adjust a signal to noise ratio ("SNR").

Broadband communication systems may be capable of repeating signals as desired to extend the transmission distance using any of several techniques. For example, transmission distances may be extended using broadband communication devices with repeating functionality. Alternatively, converting the transmitted signal to another medium, such as standard Ethernet, wireless/wired RF or fiber for transmission may extend transmission distance. Further, transmission distance may be extended by retransmitting a signal over another set of broadband communication devices using a point-to-point methodology. In another embodiment, one or more standalone repeaters or like electrical devices may be used by broadband communication system to repeat signals and extend signal transmission distances. Other methods of reducing attenuation of the transmitted signals will be known to those of ordinary skill in the art and fall within the scope of the present invention.

Systems according to an embodiment of the present application comprise broadband communication devices that may reside at predetermined locations throughout a worksite. Broadband communication devices may reside in power centers, belt starters, disconnects, pumps, couplers, and mobile equipment, but are not limited to these locations and may reside in other locations throughout a worksite as needed to accomplish a desired communication. In other embodiments, broadband communication devices may also reside above ground or away from a hostile worksite and be connected to other broadband communication devices in a hostile worksite. In some embodiments, broadband communication systems may use technology that allow repeating signals to be transmitted from one broadband communication device to be received by another broadband communication device. Further, such broadband communication systems may employ point-to-point, mesh or other methods of communications between broadband communication devices.

In embodiments using point-to-point methods, data may be processed and/or collected on a local Ethernet network and then transported via another set of broadband communication devices, or another communication medium, to another location for processing, storage, and usage. The broadband communication devices may be directly connected or coupled to ground, neutral, ground check, or phase conductors of the power cable on the high voltage distribution system.

In one embodiment, an impedance matching circuit or device may be installed at a point where a broadband communication device attaches to power cabling to compensate for impedance mismatches. An impedance matching network may be setup to be either manually or automatically "tuned" to provide for best transmission scenarios.

Each broadband communication device may interface to an Ethernet or other data communication network and transport data over power cabling. Serial devices may be converted to Ethernet to allow transmission either by an external convertor or directly converted by the broadband communication device. In some embodiments, broadband communication devices may comprise modems. Modems, which are not protocol dependent, may modulate any protocols or data to broadband communication device signals. Modems may also demodulate any broadband communication device signals to protocols or data. In some embodiments, broadband communication devices may also comprise a battery, an uninterruptable power supply, a capacitor or some other energy storing device to provide power to broadband communication devices and allow for communications during power outages.

Figure 2:
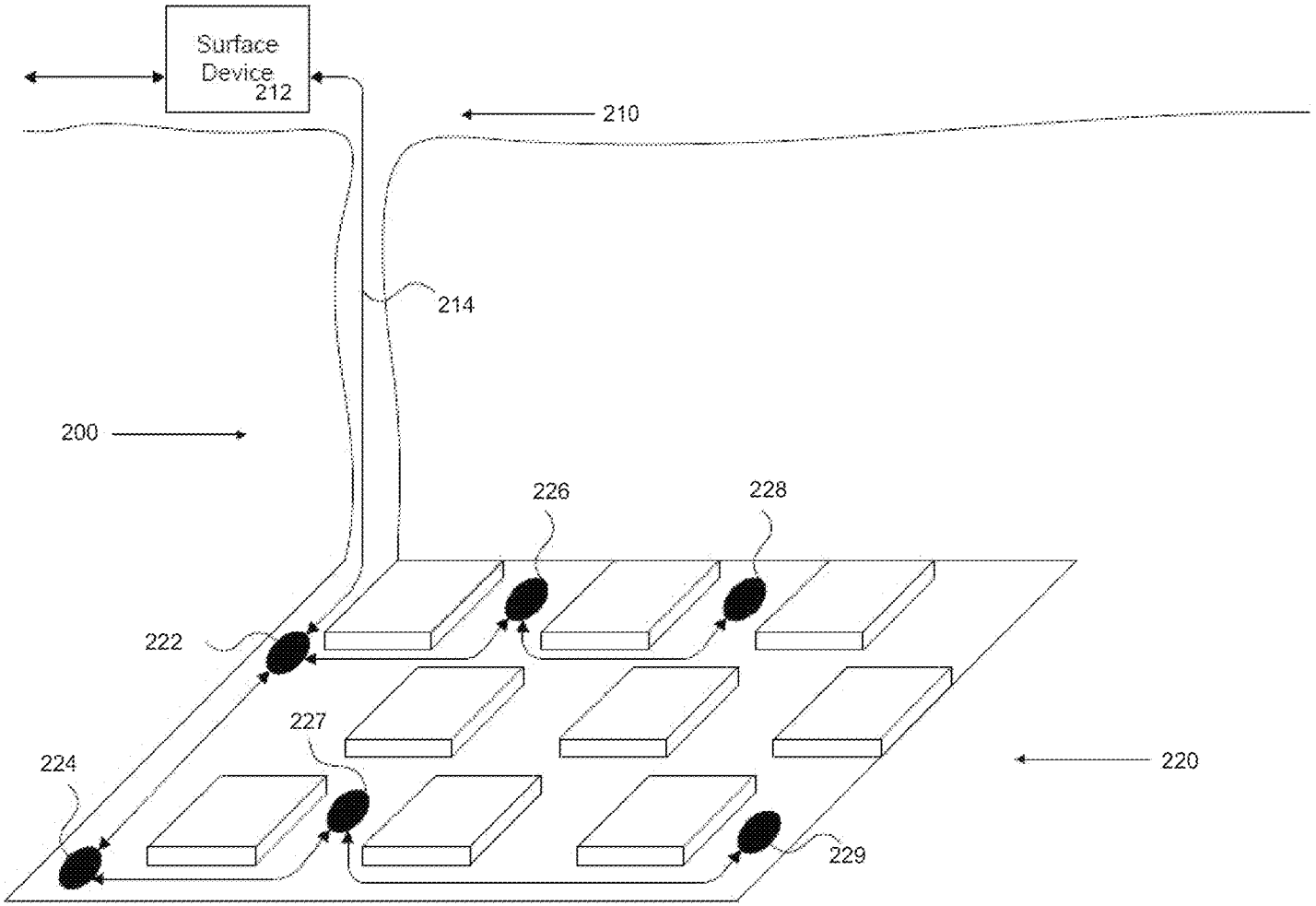
FIG. 2 is a schematic block diagram illustrating an example environment.

Referring now to FIG. 2, there is illustrated an example environment 200. Example environment 200 is a mining environment comprising a surface or above-ground portion 210 and an underground portion 220. Surface portion 210 comprises a surface device 212 that receives power from a power source such as a public utility electric grid and transmits power to equipment in the underground portion 220 via power cabling 214. Surface device 212 may be a substation or power center.

Equipment in underground portion 220 comprises underground devices 222, 226, 228, and 229 as well as couplers 224 and 227. Couplers 224 and 227 may comprise electric couplers that connect stretches of high voltage cables underground. In one embodiment, couplers 224 and 227 comprise integrated broadband communication devices that act as and/or comprise modems, repeaters, filters, frequency blocking devices, signal monitors/adjusters, SNR monitors/adjusters, line conditioners, and data collection devices, such that integrated broadband communication devices may: modulate and demodulate signals, amplify a signal for further transmission over power cabling, attenuate and pass signals of certain frequencies, monitor and adjust signals, monitor and adjust SNR over power cabling, deliver a voltage at proper level and characteristics to run worksite equipment properly, collect and store data, and perform other such functions associated with such devices.

In one embodiment, couplers 224 and 227 are mechanical coupling devices that provide at least one of: a connection between power cables, a connection between power cables and worksite equipment, and a connection between power cables and broadband communication devices. In one embodiment, couplers 224 and 227 include connectors, potheads, terminators and like devices. In another embodiment, couplers 224 and 227 include magnetic or electrical coupling devices that allow for inductive and capacitive coupling. Couplers 224 and 227 may couple to a metal frame of worksite equipment (not shown) and interface with connections on worksite equipment (not shown) to provide an electrical energy to worksite equipment.

In one embodiment, worksite equipment 222, 226, 228, and 229 may comprise any of a number of stationary or mobile underground devices having an integrated or associated broadband communication device for communicating data over underground power cabling. The example devices and example connection methodologies are described with reference to FIGS. 3-14 below.

Figure 3:
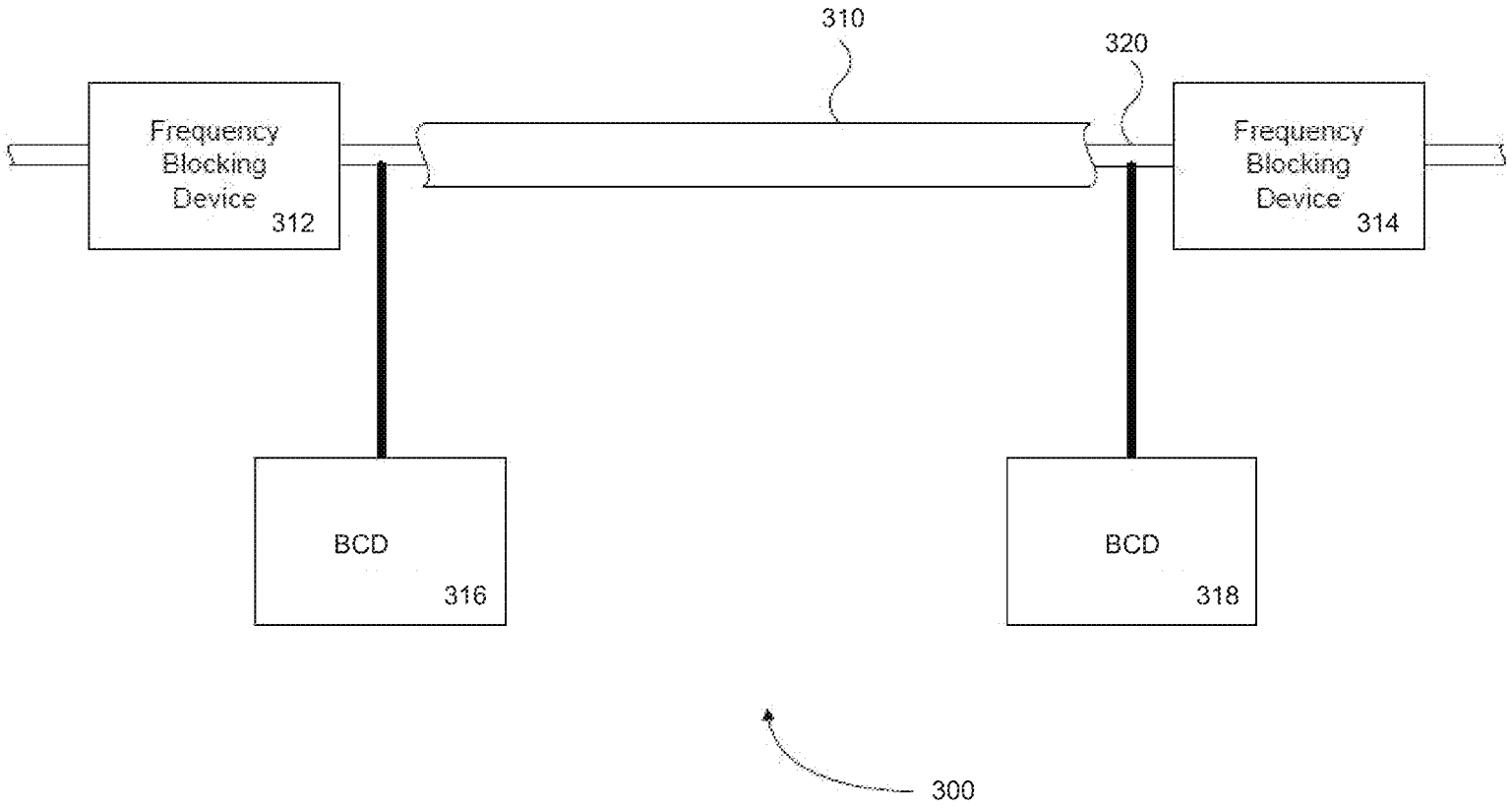
FIG. 3 is a schematic block diagram illustrating an example broadband communication system.

Referring now to FIG. 3, there is illustrated a first example system 300 for transmitting broadband communication signals. System 300 is a signal isolation system that comprises a shielded power cable 310 comprising a shielded conductor 320. System 300 further comprises two broadband communication devices 316 and 318 connected to shielded conductor 320. Shielded conductor 320 may provide a broadband communication path between broadband communication devices 316 and 318.

As illustrated, frequency blocking device 312 and 314 are installed on the shielded power cable 310 outside of either end of the communication path between broadband communication devices 316 and 318. Frequency blocking devices 312 and 314 may prevent or block signals from being attenuated by multipaths. Frequency blocking devices 312 and 314 may further prevent broadband devices 316 and 318 from communicating with other broadband communication devices that may utilize other portions of shielded power cable 310 to transmit broadband communications. In another embodiment, frequency blocking devices 312 and 314 may prevent at least one of: crosstalk, noise, capacitive coupling, inductive coupling, and conductive coupling, on all or part of power cable 310 in system 300.

Frequency blocking devices 312 and 314 may also prevent or mitigate signal interference from other broadband communication devices (not shown) that may utilize other portions of shielded power cable 310. Frequency blocking devices 312 and 314 may thereby create a single point-to-point communication path for signals between broadband communication devices 316 and 318. In one embodiment, frequency blocking devices 312 and 314 comprise a ferrite core, bead, or similar device tuned to block certain signal frequencies.

With respect to mine electrical distribution system 100 illustrated in FIG. 1, the mine may benefit from this embodiment, for example, by utilizing one or more instances of the embodiment in one or more locations of cables 130, 140, and/or 150 or power center 120 and distribution transformer 180 and/or switchhouse 110.

Figure 4:
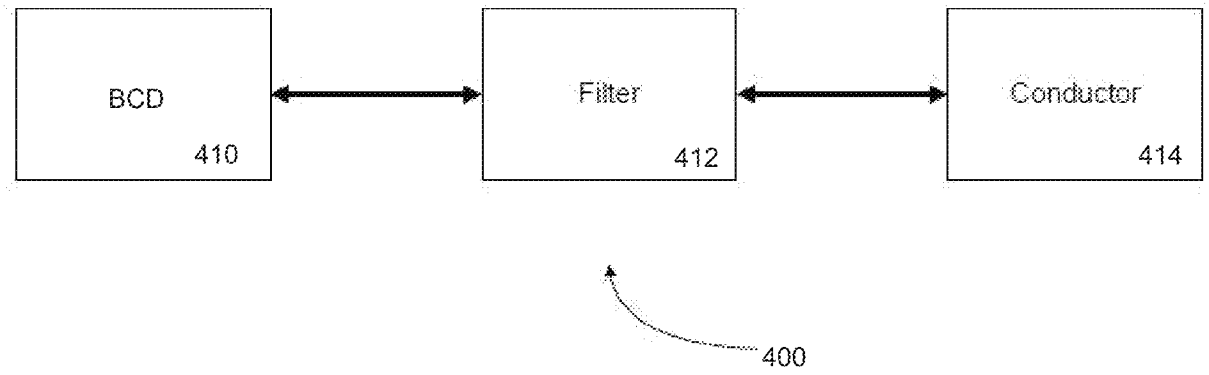
FIG. 4 is a schematic block diagram illustrating an example system connecting a broadband communication device to a conductor.

Referring now to FIG. 4, there is illustrated an example system 400 for connecting a broadband communication device 410 to a conductor 414. As illustrated, broadband communication device 410 may be connected to conductor 414 via a filter 412. Filter 412 may comprise a device or circuit for tuning, filtering, and impedance matching. Filter 412 may comprise passive components such as resistor(s), capacitor(s), and inductor(s) as required. Filter 412 may be manually set up and/or tuned. Alternatively, filter 412 may be configured to automatically adjust using a microcontroller- or microprocessor-based control system. In one embodiment, filter 412 may be any one of a: high pass filter (HPF), a low pass filter (LPF), and a band-pass filter (BPF). Filter 412 may be selected based on a frequency to be filtered. For example in one embodiment filter 412 is a high pass filter passing 100 kHz and above.

Although a single lead is illustrated, filter 412 may accommodate multiple leads from broadband communication device 410, and filter 412 may also accommodate connection to multiple conductors, such as conductor 414. Further, filter 412 may be integrated into broadband communication device 410. Filter placement on the system may vary for purposes of impedance matching and other system design considerations.

With respect to mine electrical distribution system 100 illustrated in FIG. 1, the mine may benefit from this embodiment for example by utilizing one or more instances of the embodiment in one or more locations on cables 130, 140, and/or 150.

Figure 5:
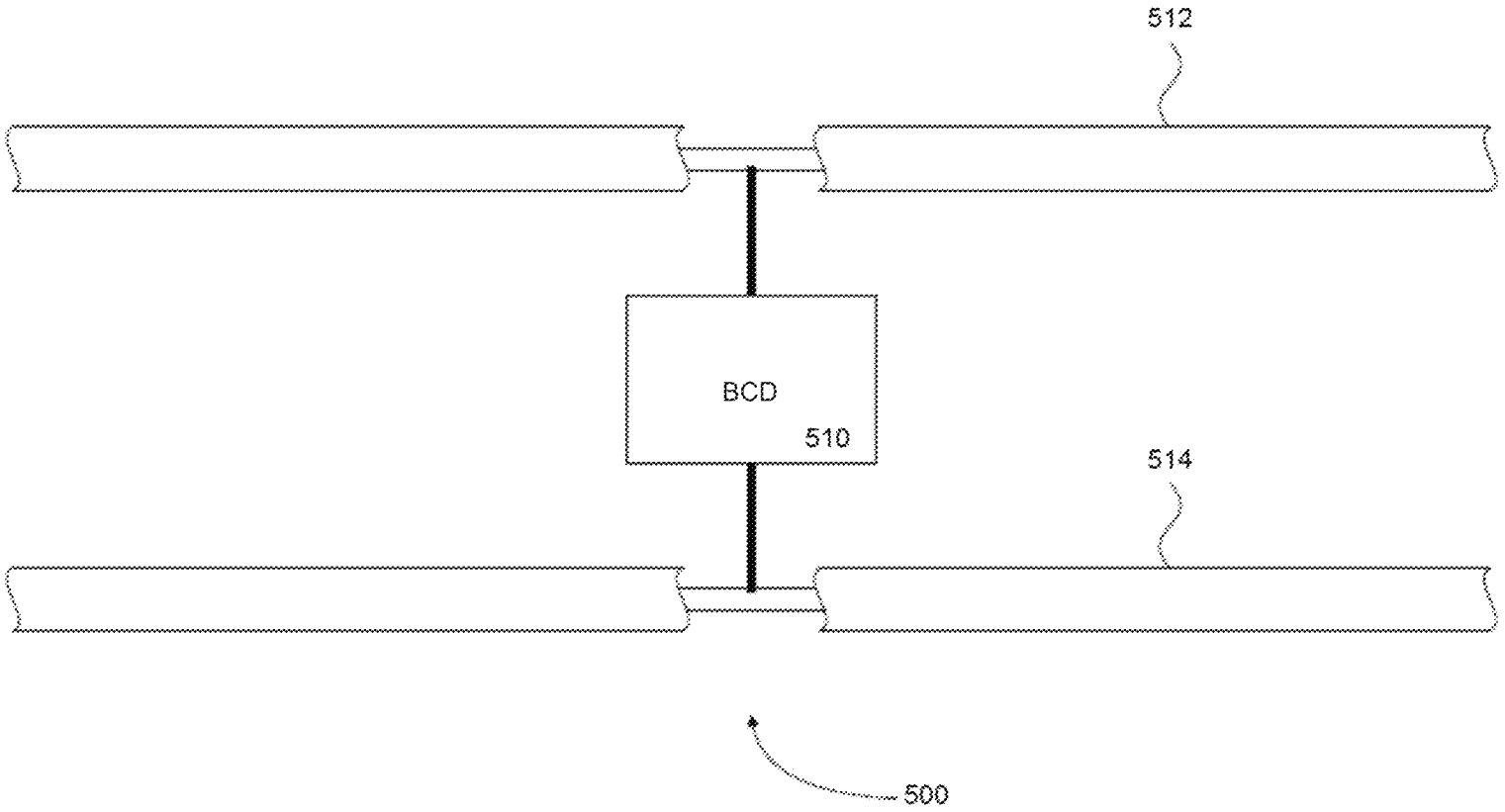
FIG. 5 is a schematic block diagram illustrating an example coupling methodology.

Referring now to FIG. 5, there is illustrated an example coupling methodology 500. As illustrated, a single broadband communication device 510 may be connected to multiple power cables 512 and 514 in a system for communicating to and from hostile locations such as underground locations using, in one embodiment, BPL. In one embodiment, power cables 512 and 514 are a shielded high voltage power cable, such as an MPF-GGC three-conductor mine power cable. In another embodiment, power cables 512 and 514 are any one of or a combination of: MP-GC, G-GC, Type W, DLO, submarine cables, and any like power cabling used in hostile environments. Broadband communication device 510 may be connected to one or more phase, ground or ground check conductors of two different cables. Of course, in alternate embodiments, frequency blocking devices and filters described above may be employed to improve performance.

Figure 6:
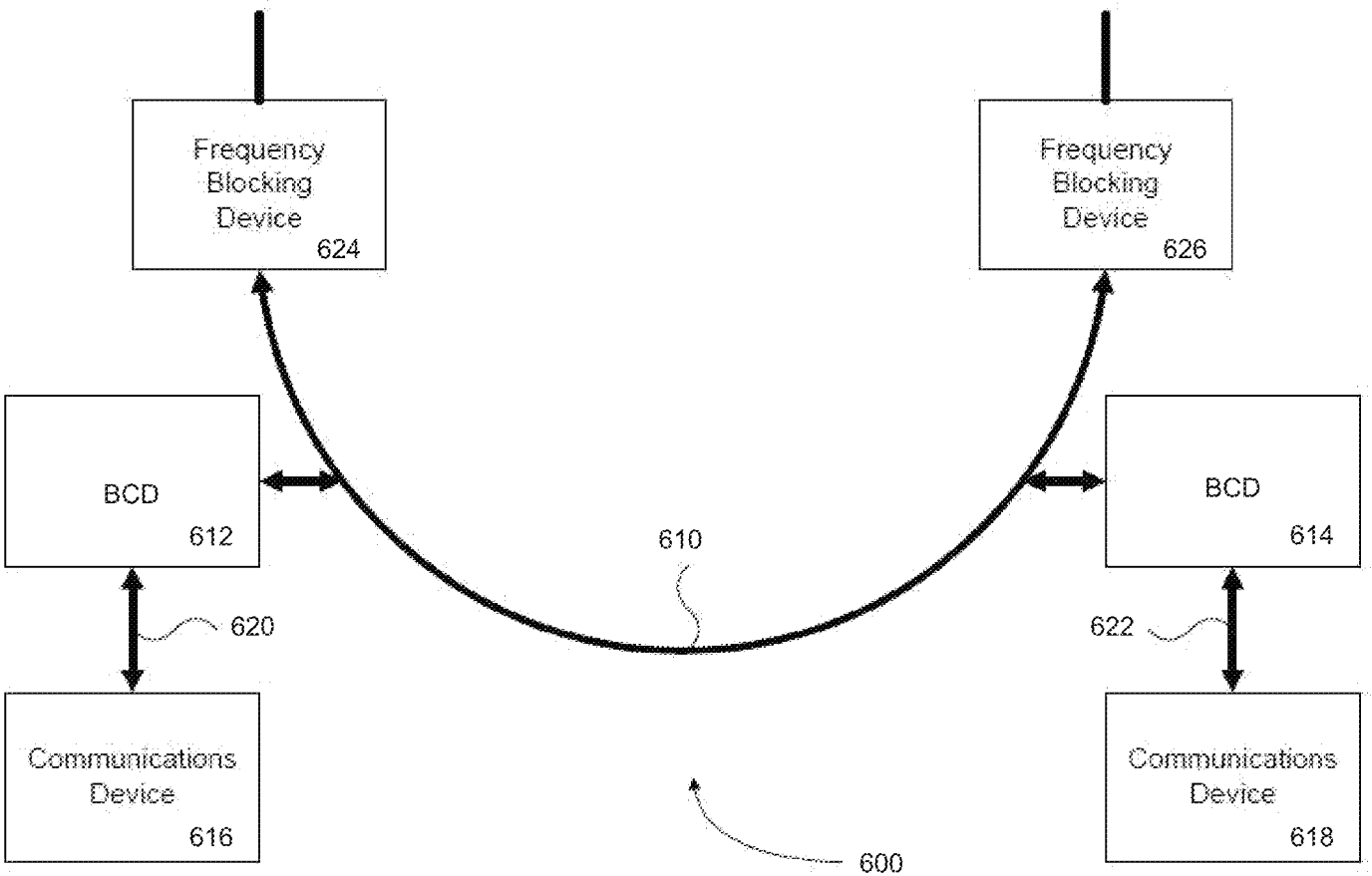
FIG. 6 is a schematic block diagram illustrating an example point-to-point communication system.

Referring now to FIG. 6, there is illustrated an example point-to-point communication system 600 for providing broadband communication over mine power cabling. As shown, system 600 comprises a mine power cable 610 connecting two broadband communication devices 612 and 614. Optionally, system 600 may further include one or more frequency blocking devices, such as frequency blocking devices 624 and 626. Broadband communication devices 612 and 614 are connected to communication devices 616 and 618, respectively, to facilitate broadband communications between the communication devices. Broadband communication devices 612 and 614 may be connected to communication devices 616 and 618, respectively, by communication lines 620 and 622. Communication lines 620 and 622 may be Ethernet, serial, fiber optic, or other type of communication line as desired to be compatible with both the communication device and the broadband communication device.

With respect to the mine electrical distribution system 100 illustrated in FIG. 1, the mine may benefit from this embodiment for example by utilizing one or more instances of the embodiment in one or more of the locations on power center 120 and distribution transformer 180.

Figure 7:
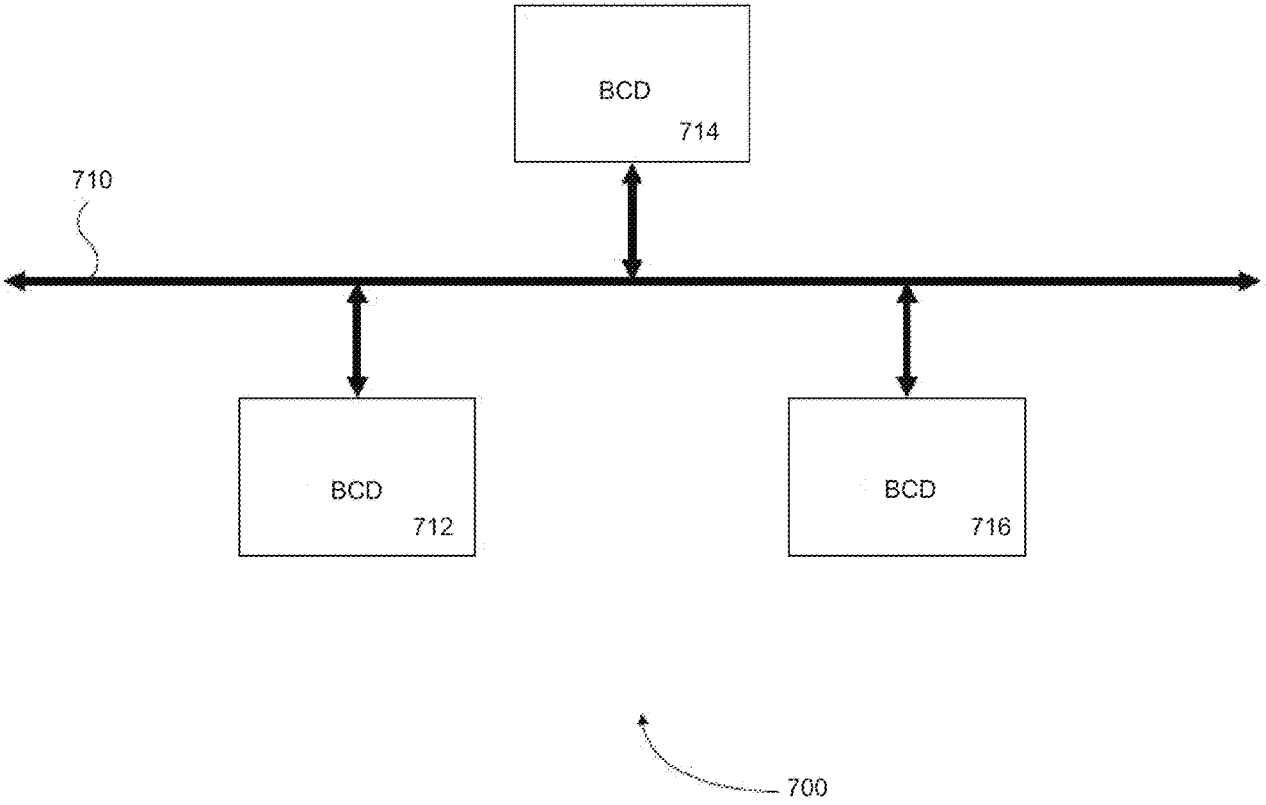
FIG. 7 is a schematic block diagram illustrating an example communication network.

Multiple broadband communication devices may be disposed at various locations along a mine power cabling to facilitate communications between and among any and all of the broadband communication devices. An example communication system 700 is illustrated in FIG. 7. System 700 comprises a plurality of broadband communication devices 712, 714, and 716 connected to one another via power cable 710. System 700 may be configured to enable each broadband communication device 712, 714 and 716 to communicate with another or several other broadband communication devices. Further, each broadband communication device 712, 714 and 716 may be configured to operate as a repeater to improve reliability and performance of system 700. With respect to mine electrical distribution system 100 illustrated in FIG. 1, the mine may benefit from this embodiment for example by utilizing one or more instances of the embodiment in one or more locations on cables 130, 140, and/or power center 120.

Figure 8:
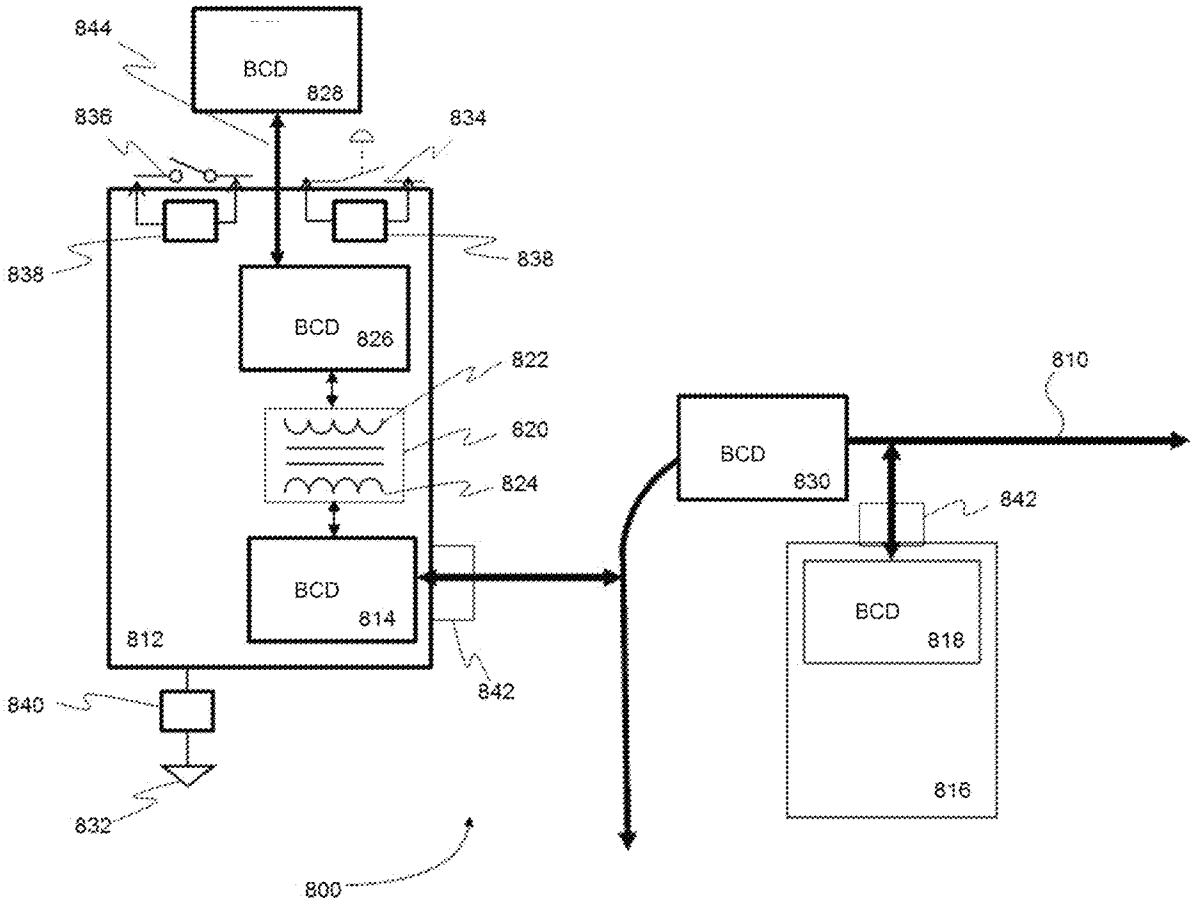
FIG. 8 is a schematic block diagram illustrating an example point-to-point communication network.

FIG. 8 illustrates an example point-to-point network 800 comprising a power center 812 and worksite equipment 816 communicating via broadband over a power cable 810. Power center 812 includes a power distribution transformer 820 with a primary winding 822 and a secondary winding 824. Power center 812 and worksite equipment 816 may be coupled to power cable 810 in any of the ways described above with reference to broadband communication devices. In one embodiment, power center 812 and worksite equipment 816 are coupled to power cable 810 via couplers 842 on a metal frame of power center 812 and worksite equipment 816. Broadband communication device 826 may be coupled to primary winding 822 of power distribution transformer 820 within power center 812. Broadband communication device 814 may be coupled to secondary winding 824 of power distribution transformer 820 within power center 812. Broadband communication device 828 may be operatively connected to power cable 844 also in connection with power center 812. Broadband communication device 830 may be operatively connected to power cable 810 and may be used as a repeater or signal conditioner to amplify, retransmit, or condition signals sent over cable 810.

In some embodiments, power center 812 may be a belt starter or similar voltage distribution point. Worksite equipment 816 may be stationary, such as pumps, motors, and battery chargers, or mobile, such as continuous miners, shuttle cars, drag lines, and electric trucks. Data, voice, and/or video may be transmitted between power center 812 and worksite equipment 816 and further transmitted to broadband communication device 828 to be sent elsewhere in system 800. Information transmitted between power center 812 and worksite equipment 816 may be stored at either or both devices. Alternatively, information may be transmitted/repeated on to another location via broadband communication devices 830 and 828, fiber optic, or any other communication method. Power center 812 further comprises signal path to ground 832, emergency stop switch 834, and interlock switch 836. Additionally, power center 812 may include high pass filter 838 across emergency stop switch 834 and interlock switch 836 and low pass filter 840 operatively connected to ground path 832.

With respect to mine electrical distribution system 100 illustrated in FIG. 1, the mine may benefit from this embodiment, for example, by utilizing one or more instances of the embodiment in one or more of the locations of power center 120, equipment 170, and distribution transformer 180.

Figure 9:
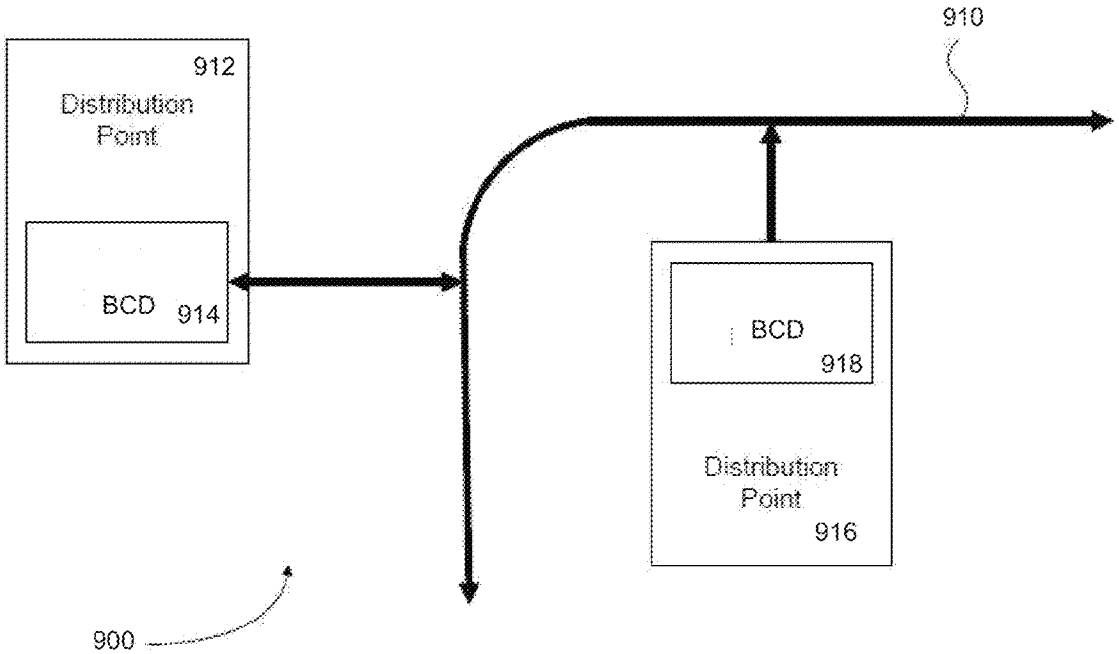
FIG. 9 is a schematic block diagram illustrating an example point-to-point communication network.

FIG. 9 illustrates an example point-to-point network 900 where each node comprises a distribution point for other devices. Specifically, FIG. 9 illustrates a power cable 910 which enables broadband communications between distribution point 912 and distribution point 916. Each distribution point 912 and 916 comprises a broadband communication device 914 and 918, respectively to enable broadband communications. Each distribution point may be connected to and/or communicate with other devices that are not directly connected to power cable 910.

Data, voice and/or video may be transmitted between distribution points 912 and 916. Information transmitted between distribution points 912 and 916 may be stored at either or both devices. Alternatively, information may be transmitted/repeated on to another location via BPL, DSL, fiber optic, or any other communication method.

With respect to mine electrical distribution system 100 illustrated in FIG. 1, the mine may benefit from this embodiment, for example, by utilizing one or more instances of the embodiment in one or more of the locations of power center 120 and distribution transformer 180.

Figure 10:
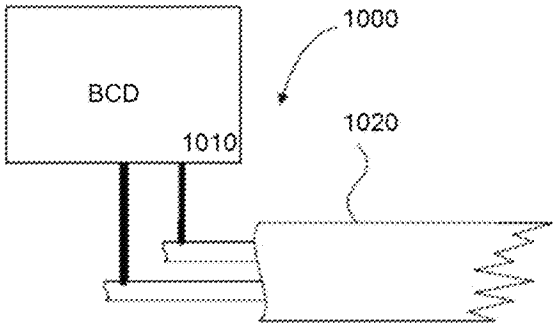
FIG. 10 is a schematic block diagrams illustrating a coupling methodology.

FIGS. 10-13 illustrate several example coupling methodologies to connect a broadband communication device to a shielded high-voltage power cable. FIG. 10 illustrates a direct connect methodology 1000. Broadband communication device 1010 is directly connected to conductors within shielded cable 1020. The conductors may be individual or paired phase, ground, ground check conductors, or any other conductive path within cable 1010.

Figure 11:
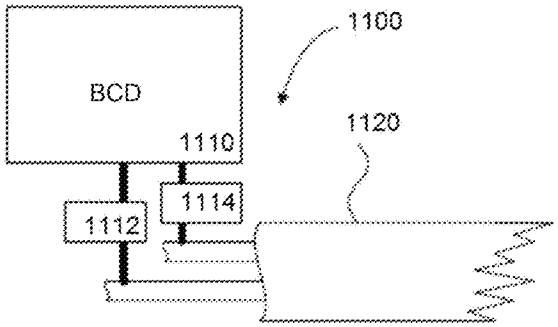
FIG. 11 is a schematic block diagrams illustrating a coupling methodology.

FIG. 11 illustrates an inductive or capacitive coupling methodology 1100. Broadband communication device 1110 is connected to conductors within shielded cable 1120 using inductive or capacitive coupling devices 1112 and 1114. The conductors may be individual or paired phase, ground, ground check conductors, or any other conductive path within cable 1010.

Figure 12:
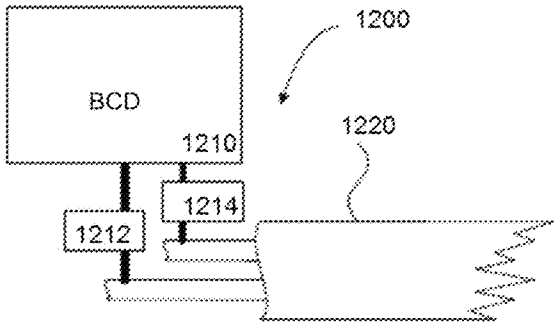
FIG. 12 is a schematic block diagrams illustrating a coupling methodology.

FIG. 12 illustrates a filtered or tuned coupling methodology 1200. Broadband communication device 1210 is connected to conductors within shielded cable 1220 using filters 1212 and 1214. The conductors may be individual or paired phase, ground, ground check conductors, or any other conductive path within cable 1210. Each filter 1212 and 1214 comprises a tuning circuit and may be manually or automatically tuned for impedance matching or impedance changing capabilities. Each filter 1212 and 1214 may also monitor and/or adjust a signal. Each filter 1212 and 1214 may further monitor and adjust a SNR.

Figure 13:
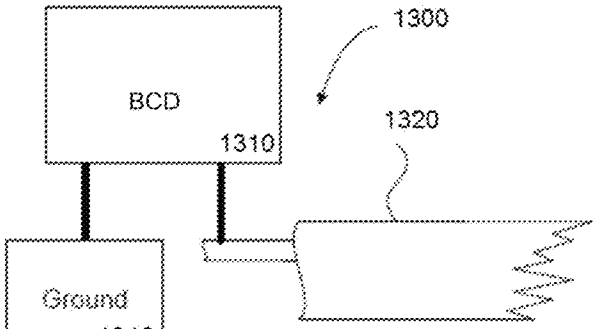
FIG. 13 is a schematic block diagrams illustrating a coupling methodology.

FIG. 13 illustrates a common ground coupling methodology 1300. A first lead of broadband communication device 1310 is connected to a conductor within shielded cable 1320 and a second lead of broadband communication device 1310 is connected to a common ground, such as a mine roof support system. Although direct connections are illustrated in FIG. 13, other connection techniques may be employed. The first lead may be connected to an individual or paired phase, ground, ground check conductors, or any other conductive path within cable 1310.

Figure 14:
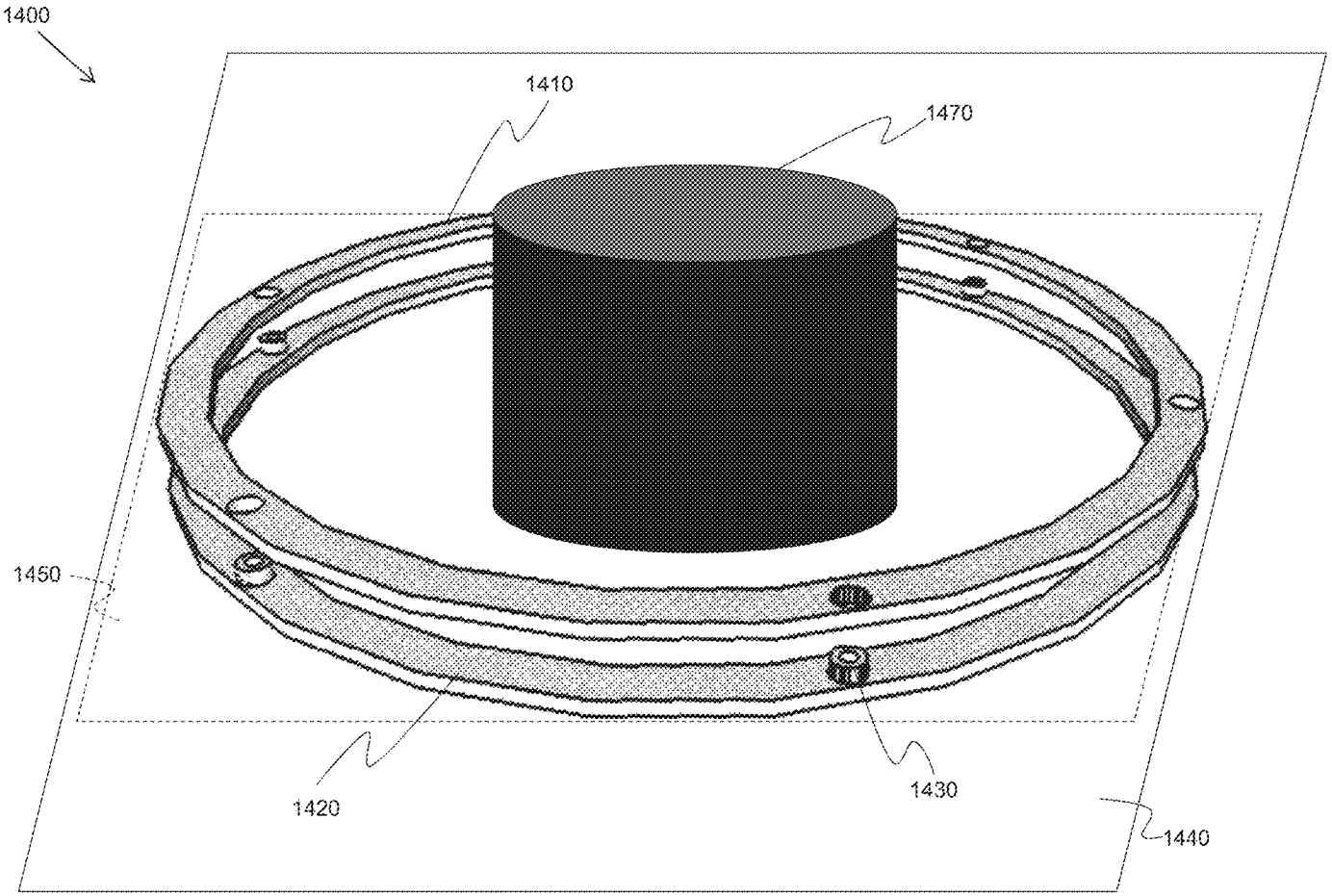
FIG. 14 illustrates one embodiment of a signal isolation ring.

Signal paths to ground inherent in power distribution systems degrade communication signals. For example when using a ground wire as a communication path, the signal may pass through couplers. Since a coupler's aluminum housing is physically connected to a ground conductor pin in a coupler, and a coupler housing is mechanically connected to a metal frame of underground mining equipment, such mechanical connection also provides a signal path to ground connection. FIG. 14 illustrates one embodiment of a signal isolation ring 1400 operable to prevent a signal path to ground before it is received by a broadband communication device in mining equipment. In one embodiment, signal isolation ring 1400 may comprise a first isolation ring 1410 and a second isolation ring 1420. One or more insulating devices, such as an electrical bushing 1430 may separate first isolation ring 1410 from second isolation ring 1420. In one embodiment, first isolation ring 1410 may be operatively connected to an inside of an equipment frame 1440 and second isolation ring 1420 may be operatively connected to an outside of an equipment frame 1450 such that an electrical connection established through signal isolating ring 1400 on worksite equipment (not shown) will insulate signals on wire 1470 from being grounded by frames 1440 and 1450 when a broadband communication device (not shown) integrated on worksite equipment (not shown) is operatively connected to wire 1470.

With respect to mine electrical distribution system 100 illustrated in FIG. 1, the mine may benefit from this embodiment, for example, by utilizing one or more instances of the embodiment in one or more of the locations power center 120, switchhouse 110, and conveyor belt starter 180.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include ±10% of the number. In other words, "about 10" may mean from 9 to 11. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

What is claimed:

1. An underground mining communication system comprising a power distribution system, the power distribution system comprising a substation, a switchgear, and one or more power center, the one or more power center comprising one or more electrical energy input, one or more electrical energy output, one or more connection operatively connected to the one or more electrical energy output, one or more power distribution transformer, the one or more power distribution transformer operable to transfer an electrical energy from the one or more electrical energy input to the one or more energy output, wherein the one or more power distribution transformer has a primary winding and a secondary winding, at least one signal path to ground, one or more emergency stop switches, one or more interlock switches, the one or more power center further operable to provide the electrical energy via the one or more connection;

one or more mine power cable, the one or more mine power cable having one or more connection and operable to connect to at least one of the one or more connection of the one or more power center, one or more connection operatively connected to one or more broadband communication device, and one or more mechanical connection operatively connected to mining equipment;

one or more trailing power cable, the one or more trailing power cable having one or more connection operable to connect to at least one of the one or more connection of the one or more power center, the one or more connection of the one or more broadband communication device, and the one or more mechanical connection of the mining equipment;

one or more first frequency blocking device, the one or more first frequency blocking device is operatively connected to the signal path to ground of the power center, and wherein the first frequency blocking device is a low pass filter;

one or more second frequency blocking device, the one or more second frequency blocking device, is operatively connected to at least one of the one or more emergency stop switches of the one or more power center, the one or more interlock switches of the one or more power center, and one or more first broadband communication device, the one or more first broadband communication device operatively connected to the one or more mine power cable, the one or more first broadband communication operable to at least one of modulate and demodulate signals, and transmit and receive signals via the one or more mine power cable;

one or more second broadband communication device, the one or more second broadband communication device operatively connected to the one or more mine power cable and the primary winding of the one or more power distribution transformer, the one or more second broadband communication device operable to at least one of modulate and demodulate signals, and transmit and receive signals via the one or more mine power cable;

one or more third broadband communication device, the one or more third broadband communication device operatively connected to the secondary winding of the one or more power distribution transformer and least one of the one or more mine power cable, and the one or more trailing power cable, the one or more third broadband communication device operable to at least one of modulate and demodulate signals, and transmit and receive signals via at least one of the one or more mine power cable, and the one or more trailing power cable; such that the one or more third broadband communication device is operable to communicate with at least the one or more second broadband communication device;

one or more fourth broadband communication device operatively connected to at least one of a fixed mining equipment, and a mobile mining equipment, and the one or more fourth broadband communication device further operatively connected to at least one of the one or more mine power cable, and the one or more trailing power cable, the one or more fourth broadband communication device operable to at least one of modulate and demodulate signals, and transmit and receive signals via at least one of the one or more mine power cable, and the one or more trailing power cable, such that the one or more fourth broadband communication device is operable to communicated with the one or more third broadband communication device via the at least one of the one or more mine power cable, and the one or more trialing power cable, such that the one or more first broadband communication device, the one or more second broadband communication device, the one or more third broadband communication device, and the one or more fourth broadband communication device are communicatively connected to each other;

a first element within the one or more broadband communication device for transmitting signals; and a second element within the one or more broadband communication device for receiving signals.

* * * * *